US009814360B2

(12) United States Patent
Gray et al.

(10) Patent No.: US 9,814,360 B2
(45) Date of Patent: Nov. 14, 2017

(54) TOILET SEAT COVER MOUNTING SYSTEM

(71) Applicant: MASCO CORPORATION OF INDIANA, Indianapolis, IN (US)

(72) Inventors: Joel Michael Gray, Fishers, IN (US); Chris Kors, Carmel, IN (US)

( * ) Notice: Subject to any disclaimer, the term of this patent is extended or adjusted under 35 U.S.C. 154(b) by 335 days.

(21) Appl. No.: 14/568,361

(22) Filed: Dec. 12, 2014

(65) Prior Publication Data

US 2015/0182081 A1 Jul. 2, 2015

Related U.S. Application Data

(60) Provisional application No. 61/922,461, filed on Dec. 31, 2013.

(51) Int. Cl.
*A47K 13/12* (2006.01)
*A47K 13/26* (2006.01)

(52) U.S. Cl.
CPC ..... *A47K 13/12* (2013.01); *A47K 13/26* (2013.01)

(58) Field of Classification Search
CPC ..... A47K 13/12
USPC ..... 4/234, 236, 240, 242.1
See application file for complete search history.

(56) References Cited

U.S. PATENT DOCUMENTS 3,670,441 A * 6/1972 Blount ..... A47K 13/12 4/235
4,197,596 A * 4/1980 Fantetti ..... A47K 13/12 4/234
4,965,890 A 10/1990 Fischer
5,842,234 A * 12/1998 Dixon ..... A47K 13/06 16/334
5,901,383 A * 5/1999 Yanagawa ..... A47K 13/12 4/236
6,052,869 A 4/2000 Suzuki
6,081,936 A 7/2000 Bargman et al.
6,243,884 B1 * 6/2001 Simonson ..... A47K 13/12 220/831
7,512,376 B2 3/2009 Suzuki
7,774,868 B2 * 8/2010 Landsberger ..... A47K 13/005 4/236
2008/0313796 A1 12/2008 Wendt
2009/0133185 A1 5/2009 Fisseha
2013/0219602 A1 8/2013 Korzelski

FOREIGN PATENT DOCUMENTS

EP 2 587 089 B1 12/2013

OTHER PUBLICATIONS

Luxury Soft Close Heavy Duty D-Shape Toilet Seat with Top Fixing Hinges Arian; http://www.ebay.co.uk/itm/LUXURY-SOFT-CLOSE-HEAVY-DUTY-D-SHAPE-TOILET; retrieved on Feb. 14, 2014.

TOTO SS114-01 Transitional SoftClose Elongated Toilet Seat, Cotton White; http://www.amazon.com/SS114-01-Transitional-SoftClose-Elongated-Toilet/dp/B0018LD; retrieved on Feb. 14, 2014.

* cited by examiner

*Primary Examiner* — Huyen Le

(57) ABSTRACT

A toilet seat cover mounting system including a seat cover configured to move longitudinally from a rearward position to a forward position as the toilet seat cover is pivoted from a lowered position to a raised position.

32 Claims, 17 Drawing Sheets

TOILET SEAT COVER MOUNTING SYSTEM

CROSS-REFERENCE TO RELATED APPLICATION

This application claims priority to U.S. Provisional Application Ser. No. 61/922,461, filed Dec. 31, 2013, the disclosure of which is expressly incorporated herein by reference.

BACKGROUND AND SUMMARY OF THE DISCLOSURE

The present disclosure relates generally to a toilet seat assembly and, more particularly, to a toilet seat cover mounting system.

The present invention relates to a toilet seat cover which is configured to conform to a toilet bowl and provide an aesthetically pleasing appearance by maintaining a substantially continuous outer surface between the bowl and the toilet seat when in a lowered position. The toilet seat cover includes laterally spaced seat cover guides slidably supporting laterally spaced slides. The slides are illustratively coupled to the toilet bowl through at least one hinge.

A rearwardly facing surface of the seat cover acts as a cam against a cooperating surface of the toilet bowl to force the seat cover to slide forward as the seat cover is raised by pivoting about the at least one hinge. A biasing device, such as a spring, may be attached to each of the slides to force the seat cover to return to a rearward position when the seat cover is lowered by pivoting about the at least one hinge. As such, the gap between the seat cover and the toilet bowl is reduced when the seat cover is lowered, but the gap increases to provide sufficient and variable spacing to accommodate pivoting movement of the seat cover as the seat cover is raised.

When the seat cover is closed, the springs maintain the seat cover in its rearward position. When the seat cover is lifted, the rearwardly facing surface (e.g., back corner radius) of the seat cover contacts the bowl surface and acts as a cam to force the seat cover to slide forward, thereby shifting the relative position of the seat cover pivot point. When the seat cover is closed, the springs force the seat cover back to the rearwardly facing position once the rear surface has cleared the cooperating bowl surface.

According to an illustrative embodiment of the present disclosure, a toilet seat cover mounting system includes a seat, a seat cover, and a hinge operably coupled to the seat cover and supporting the seat cover for pivoting movement between a lowered position and a raised position. A slide assembly is operably coupled to the seat cover. The slide assembly includes a slide having a socket receiving the hinge, and a guide supporting the socket for sliding movement as the seat cover moves longitudinally between a rearward position and a forward position. A camming surface is supported by the seat cover and is configured to engage with a toilet bowl to move the seat cover relative to the socket from the rearward position to the forward position as the seat cover is pivoted from the lowered position to the raised position.

According to another illustrative embodiment of the present disclosure, a toilet seat cover mounting system includes an engagement surface supported by a toilet bowl. A seat cover is supported for pivoting movement relative to the toilet bowl between a lowered position and a raised position, and is supported for translational movement relative to the toilet bowl between a rearward position and a forward position. A camming surface is supported by the seat cover and is configured to cooperate with the engagement surface to translationally move the seat cover from the rearward position to the forward position as the seat cover is pivoted from the lowered position to the raised position.

According to a further illustrative embodiment of the present disclosure, a toilet seat cover mounting system includes a seat cover, and a hinge operably coupled to the seat cover and configured to support the seat cover for pivoting movement between a lowered position and a raised position. A slide assembly is operably coupled to the seat cover and is configured to support the seat cover for translational movement between a rearward position and a forward position.

According to yet another illustrative embodiment of the present disclosure, a toilet seat cover mounting system includes a toilet seat cover configured to translate between a rearward position and a forward position as the toilet seat cover is pivoted between a lowered position and a raised position.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments elected for description have been chosen to enable one skilled in the art to practice the invention.

Figure 1A:
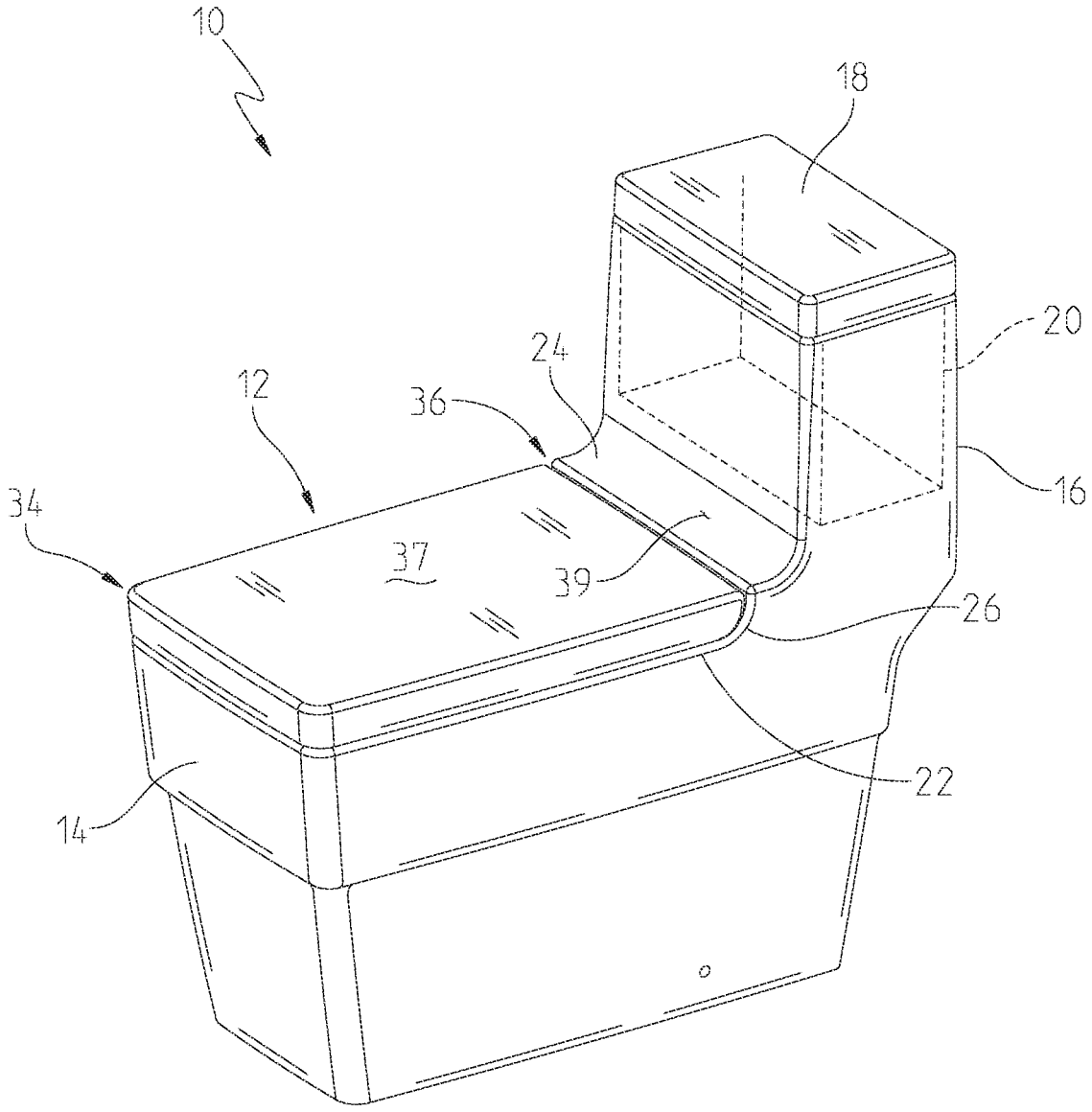
FIG. 1A is a perspective view of a toilet including an illustrative seat assembly of the present disclosure, showing the seat and the seat cover in lowered positions.
Figure 1B:
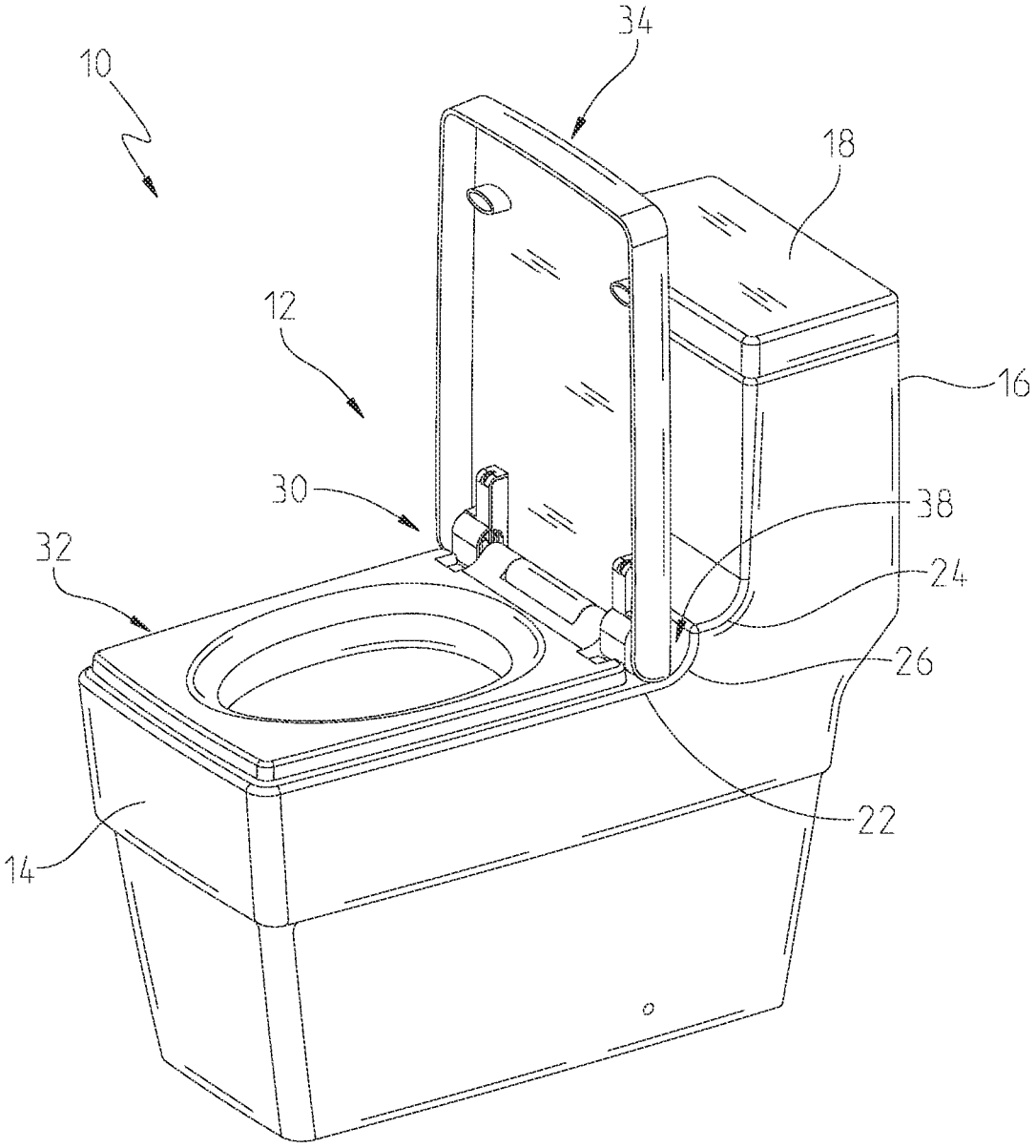
FIG. 1B is a perspective view of the toilet of FIG. 1A, showing the seat in a lowered position, and the seat cover being in a raised position.
Figure 1C:
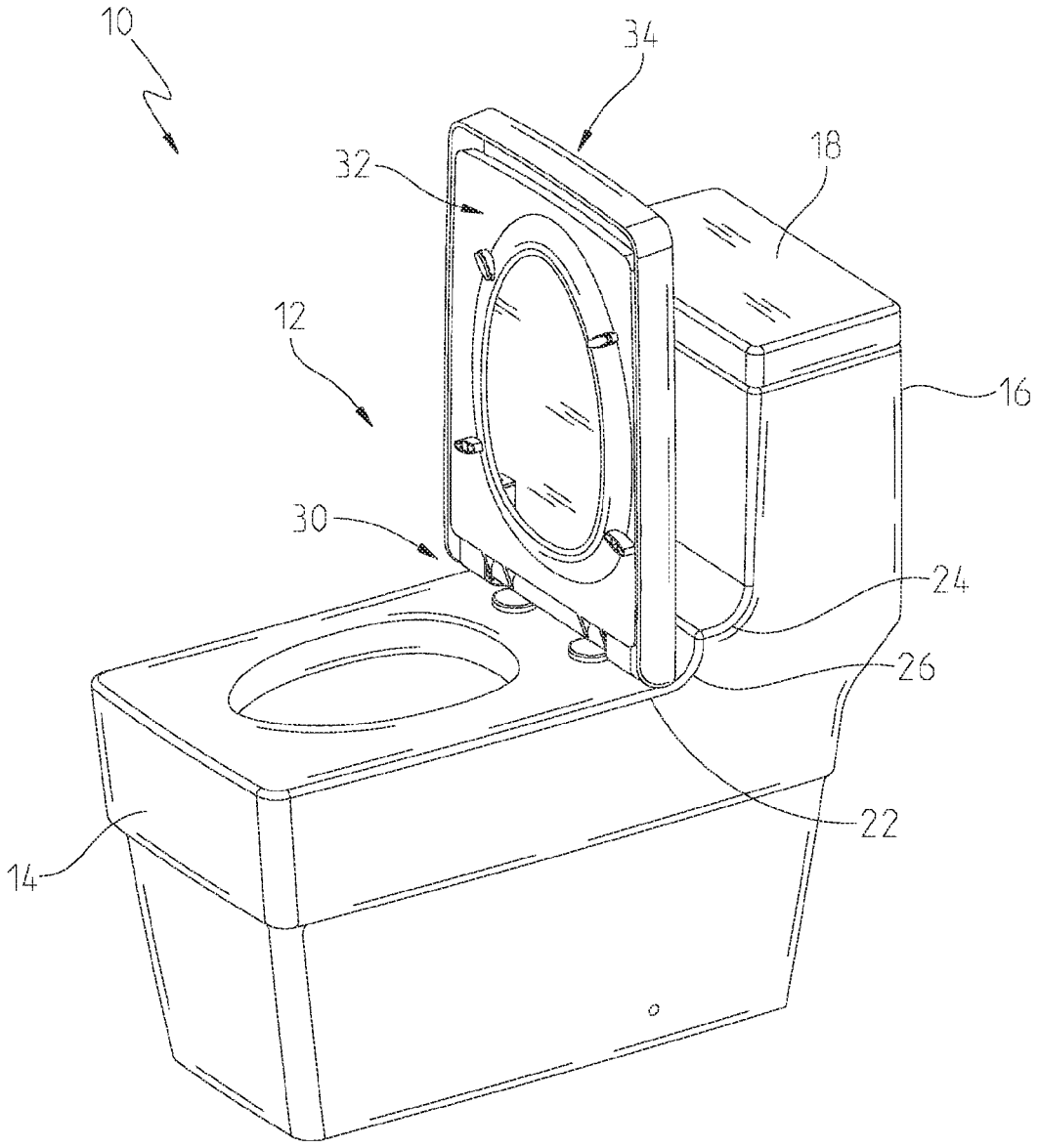
FIG. 1C is a perspective view of the toilet of FIG. 1A, showing the seat and the seat cover in raised positions.

Referring initially to FIGS. 1A-1C, a toilet 10 is shown as including an illustrative toilet seat assembly 12 of the present disclosure. As is known, the toilet 10 may include a bowl 14 and a tank 16. A lid 18 illustratively covers a water storage chamber 20 of the tank 16. The toilet bowl 14 is configured to receive water stored in the tank 16 to flush waste down a drain (not shown). The toilet bowl 14 illustratively includes a lower shelf 22 and an upper shelf 24 connected by an arcuate wall 26.

Referring now to FIGS. 2-6, the toilet seat assembly 12 is illustratively coupled to the toilet bowl 14 by the mounting system 30 of the present disclosure. The toilet seat assembly 12 includes a seat 32 and a lid or seat cover 34. Both the seat 32 and the seat cover 34 are mounted to the lower shelf 22 of the toilet bowl 14 for pivoting movement between a lowered position (FIG. 1A) and a raised position (FIG. 1C).

Figure 3A:
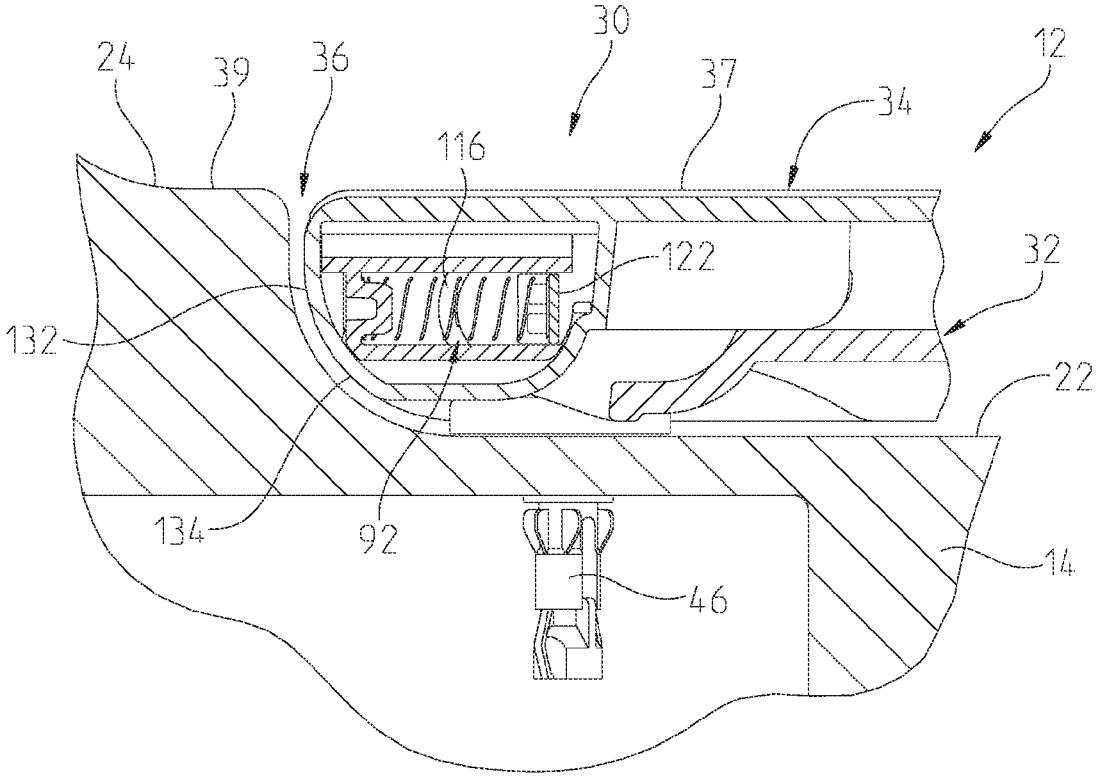
FIG. 3A is a cross-sectional view of the seat assembly of FIG. 2, showing the seat and the seat cover in lowered positions.
Figure 3B:
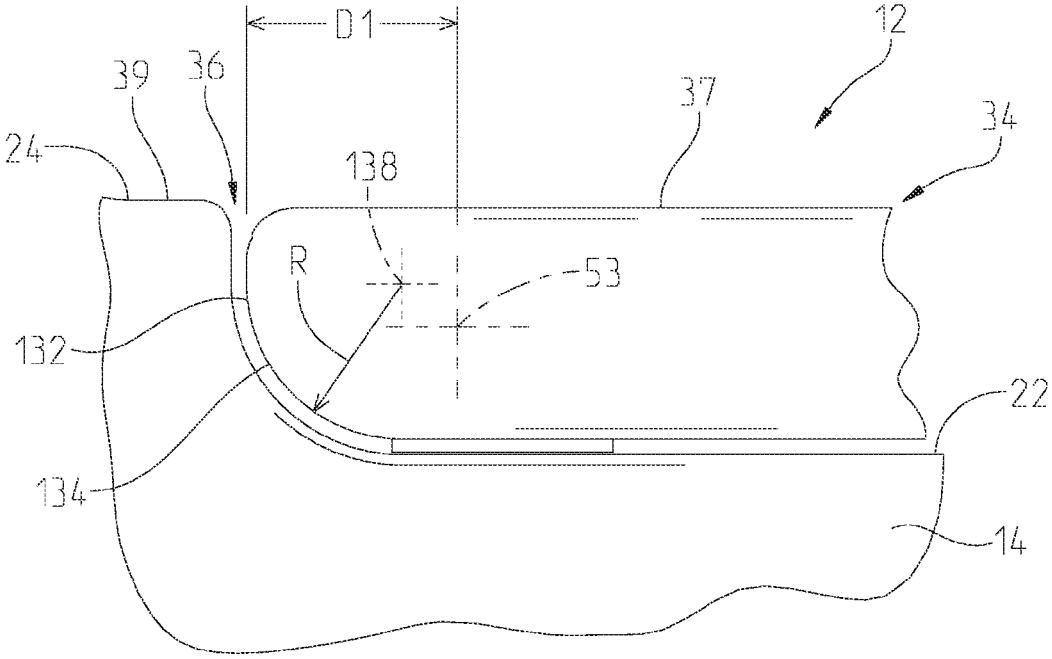
FIG. 3B is a side elevational view of the seat assembly of FIG. 3A.

More particularly, FIGS. 1A, 3A and 3B show the seat 32 and the seat cover 34 in lowered positions. In this orientation, the seat cover 34 is biased toward a rearward position adjacent the upper shelf 24 of the toilet bowl 14. As such, a reduced gap 36 exists between the seat cover 34 and the upper shelf 24. In the illustrative embodiment, an upper surface 37 of the seat cover 34 is generally within the same plane as the adjacent surface 39 of the upper shelf 24.

FIG. 1B shows the seat 32 in the lowered position of FIG. 1A, and the seat cover 34 pivoted clockwise to a fully raised position. In this orientation, the seat cover 34 has been translated in a longitudinal direction forwardly (from the position shown in FIGS. 1A, 3A and 3B) to a forward position. An increased gap 38 exists between the seat cover 34 and the upper shelf 24 to provide clearance for pivoting movement of the seat cover 34.

Figure 5A:
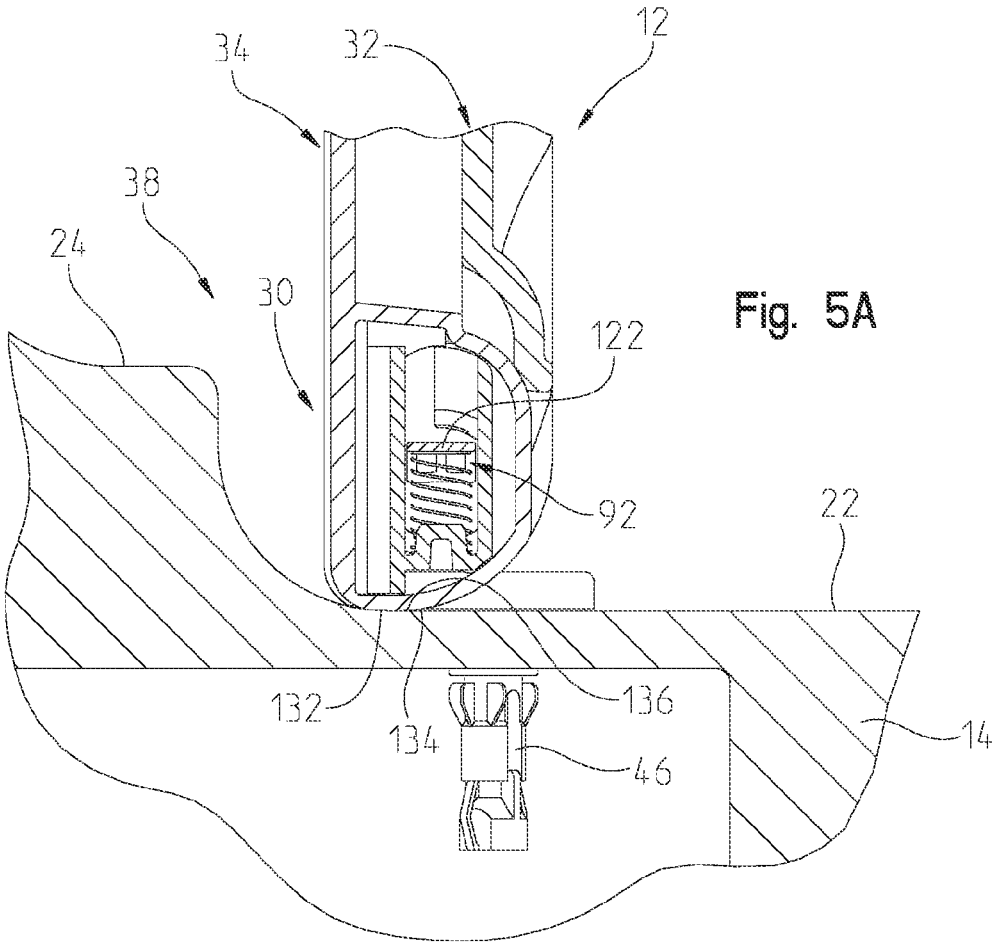
FIG. 5A is a cross-sectional view of the seat assembly similar to FIG. 3A, showing the seat and the seat cover in fully raised positions.
Figure 5B:
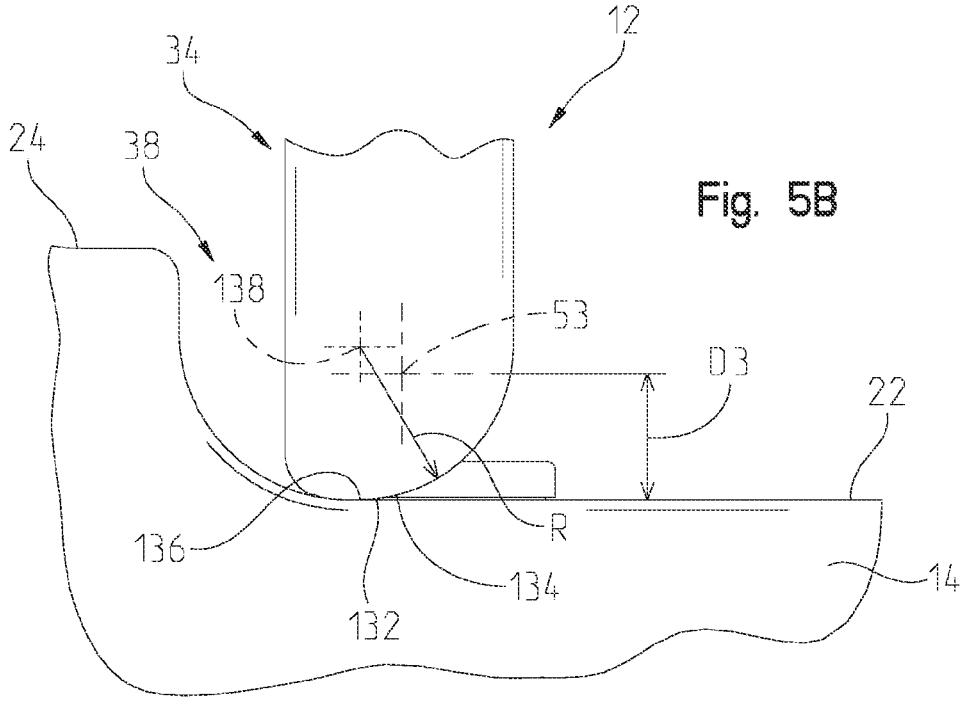
FIG. 5B is a side elevational view of the seat assembly of FIG. 5A.

FIGS. 1C, 5A and 5B show the seat 32 and the seat cover 34 in fully raised positions. It should be noted that the seat 32 remains longitudinally fixed as it pivots between the raised and lowered positions of FIGS. 1A and 1C. In other words, the seat 32 is pivotally movable but translationally fixed relative to the toilet bowl 14, while the seat cover 34 is both pivotally and translationally moveable relative to the toilet bowl 14.

Figure 11:
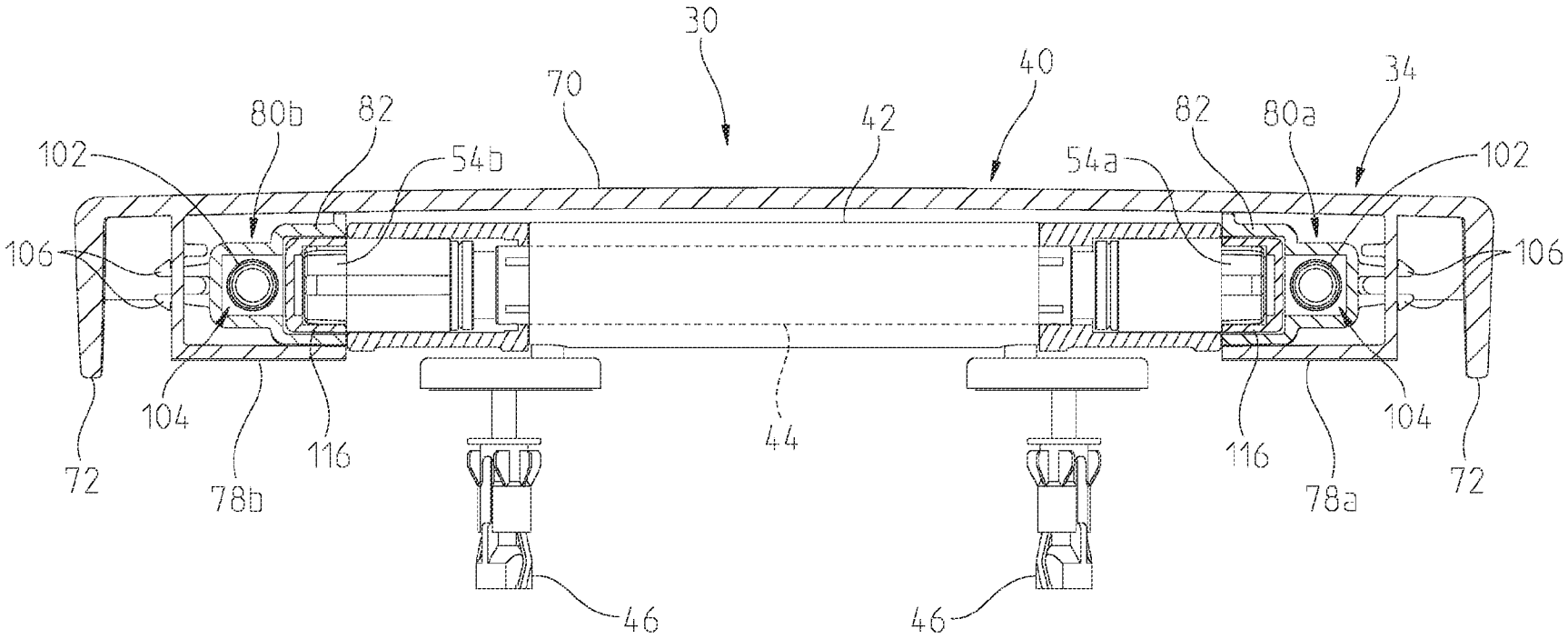
FIG. 11 is a cross-sectional view of the seat assembly taken along line 11-11 of FIG. 2.
Figure 12:
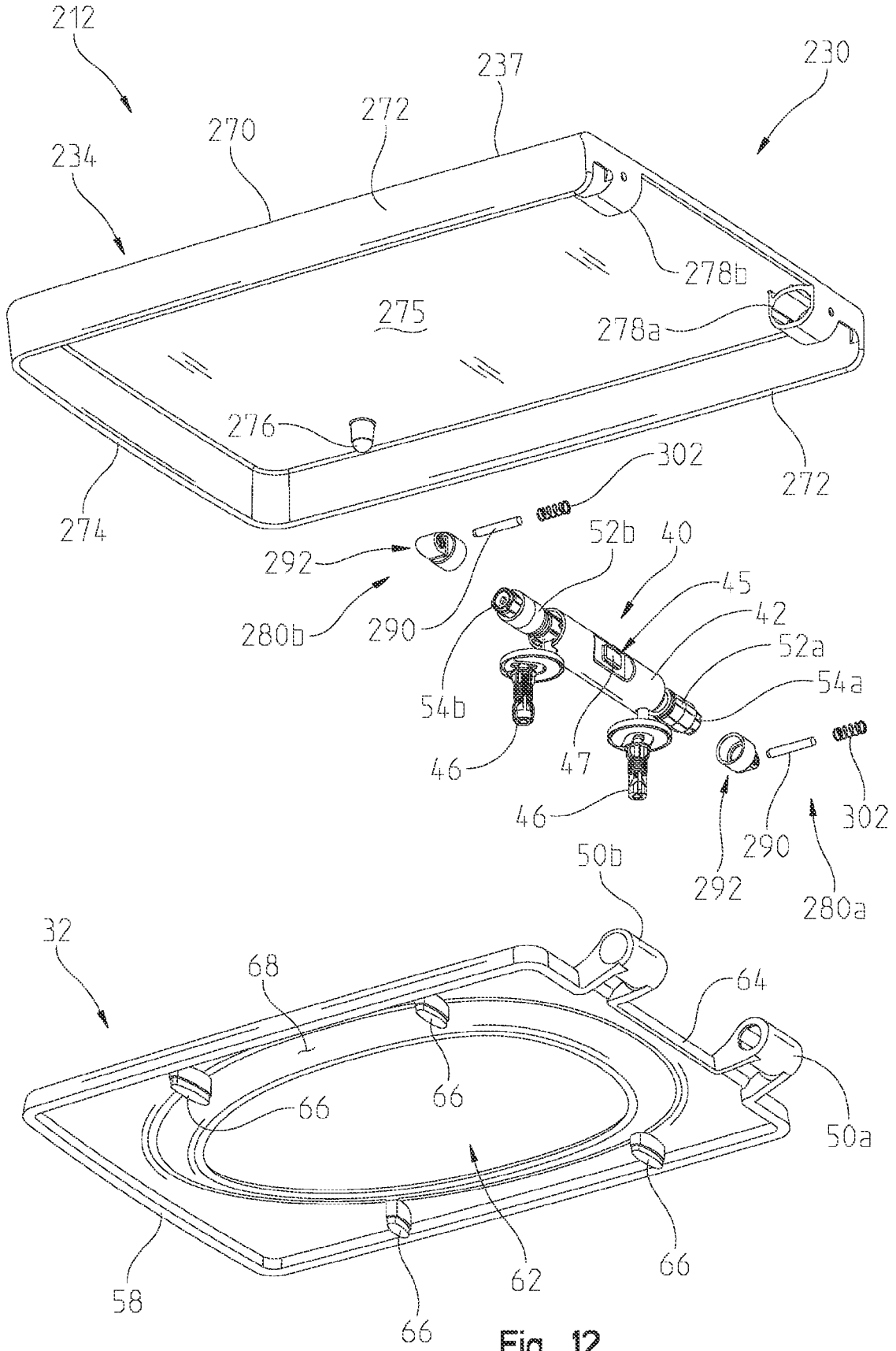
FIG. 12 is an exploded perspective view of a further illustrative seat assembly.

Pivotable mounting of the seat 32 and the seat cover 34 is provided through the mounting system 30, including a hinge assembly 40, illustratively a slow close hinge 42 of the type known in the art. More particularly, the slow close hinge 42 includes a dampener 44 to resist gravity and provide a controlled lowering of the seat 32 and the seat cover 34 (FIG. 11). The hinge 42 is illustratively secured to the toilet bowl 14 through conventional mounts 46 received within openings (not shown) of the lower shelf 22. The hinge 42 may include a conventional quick-release mechanism 45 including a release button 47 for uncoupling the seat assembly 12 from the mounting system 30, and thereby the toilet bowl 14.

The hinge assembly 40 extends laterally between opposing ends 48*a* and 48*b*. While a single hinge assembly 40 is shown in the illustrative embodiment, it should be noted that multiple hinges may be substituted therefore. The seat 32 includes laterally spaced brackets 50*a* and 50*b* which receive intermediate portions 52*a* and 52*b* of the hinge 42. The intermediate portions 52*a* and 52*b* of the hinge 42 translationally secure the seat 32 to the toilet bowl 14, while providing for pivoting movement of the seat 32 about a pivot axis 53. As further detailed herein, outer portions 54*a* and 54*b* of the hinge 42 are operably coupled to the seat cover 34. The outer portions 54*a* and 54*b* of the hinge 42 are configured to permit both translational movement of the seat cover 34 in a longitudinal direction and pivoting movement of the seat cover 34 about the pivot axis 53.

Figure 2:
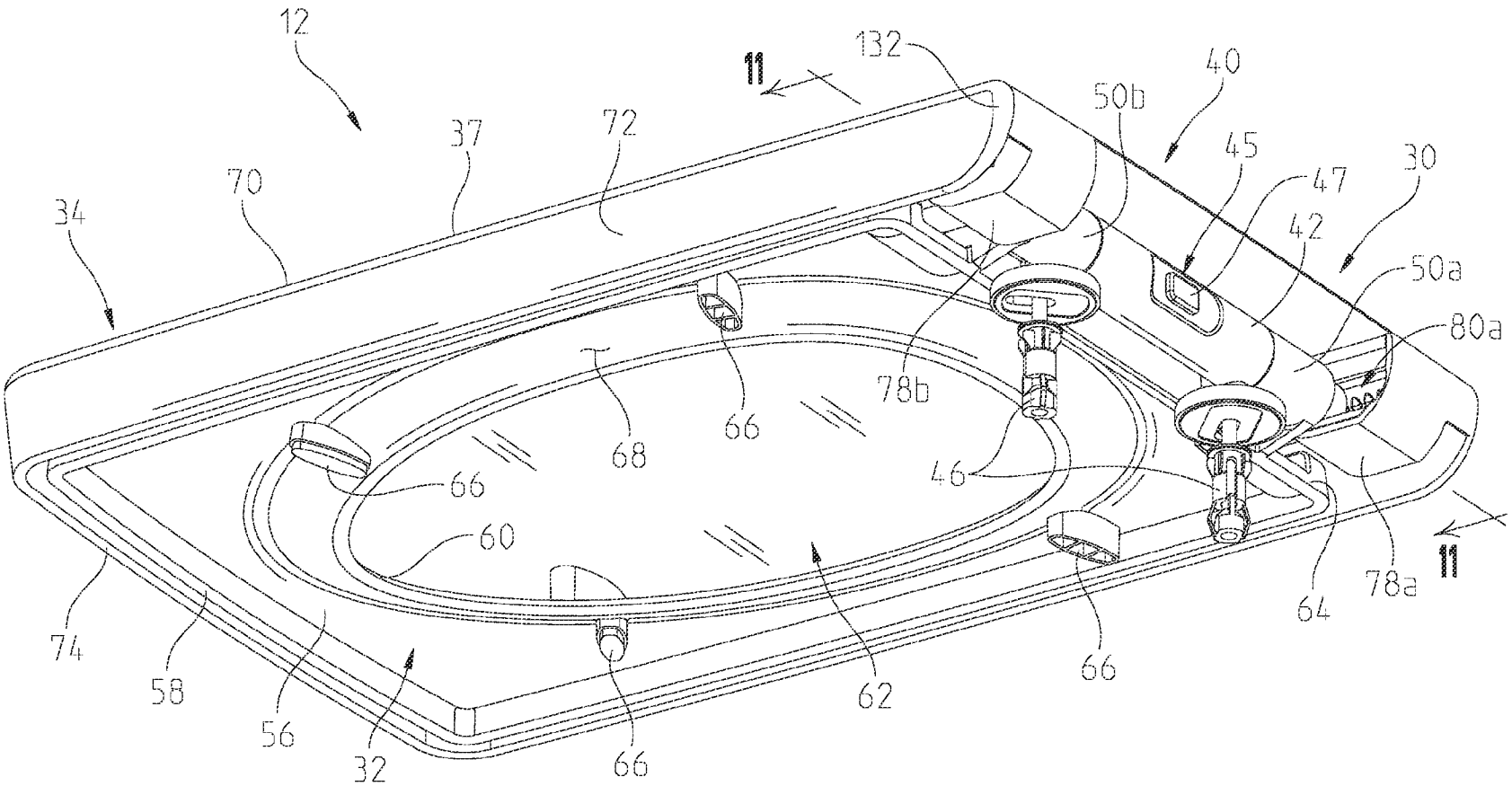
FIG. 2 is a lower perspective view of the seat assembly of FIG. 1A.
Figure 6:
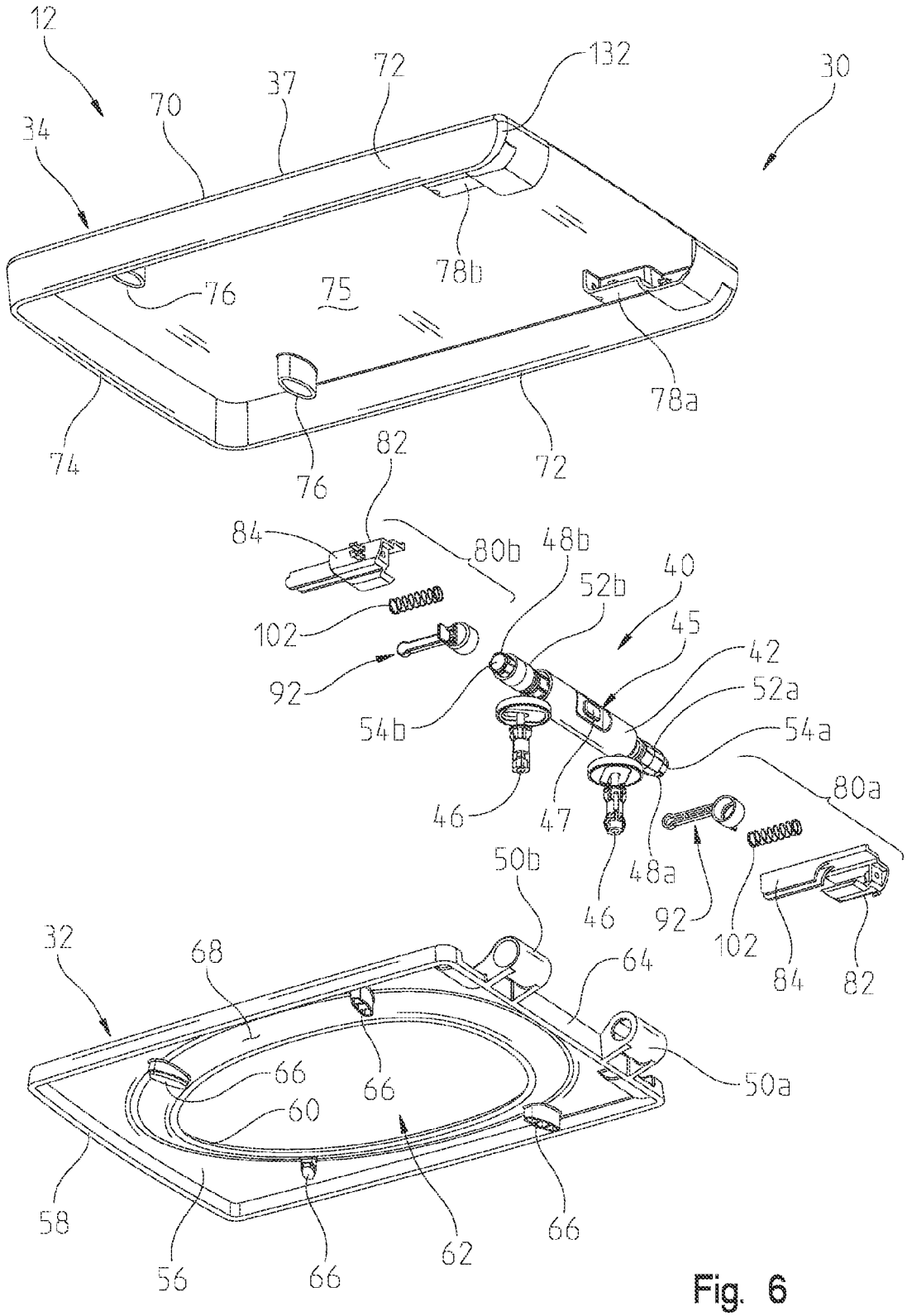
FIG. 6 is an exploded perspective view of the seat assembly of FIG. 2.

With reference to FIGS. 2 and 6, the toilet seat 32 may be of conventional design and is illustratively formed of a polymer. In the illustrative embodiment, the toilet seat 32 includes a body 56 having a rectangular outer edge 58 and an oval inner edge 60 defining an opening 62. The brackets 50*a* and 50*b* are supported by a rear edge 64 of the toilet seat 32. A plurality of standoffs 66 are supported by a lower surface 68 of the toilet seat 32 and are configured to rest upon the toilet bowl 14 when the seat 32 is in the lowered position.

The seat cover 34 may be illustratively formed of a polymer and is configured to cover the toilet seat 32 when in the lowered position. The seat cover 34 illustratively includes a top wall 70, laterally spaced side walls 72, and a front wall 74. The top wall 70 includes upper surface 37 and a lower surface 75 (FIG. 6). A plurality of standoffs 76 are illustratively supported by the lower surface 75 of the top wall 70 and are configured to rest upon the toilet seat 32 when the seat cover 34 is in the lowered position. Laterally spaced receiving pockets 78*a* and 78*b* are illustratively molded into the lower surface of the seat cover 34 and are configured to receive laterally spaced slide assemblies 80*a* and 80*b*.

The slide assemblies 80*a* and 80*b* are generally mirror images of each other. As such, the following description will focus on slide assembly 80*a* with the understanding that slide assembly 80*b* is substantially identical.

With reference to FIGS. 6-10, each slide assembly 80 includes an insert or liner 82 received within respective seat pocket 78. The insert 82 illustratively includes a polymer molded body 84 having a base 86 supporting a pair of downwardly extending walls 88*a* and 88*b* defining a longitudinally extending guide, illustratively guide track 90. A slide 92 is received for longitudinally sliding movement within the guide track 90. A first limit stop 94 is defined by walls 88, and a second limit stop 96 is defined by an end wall 98 of the pocket 78*a*. The limit stops 94 and 96 define end of travel limits of the slide 92.

Figure 7A:
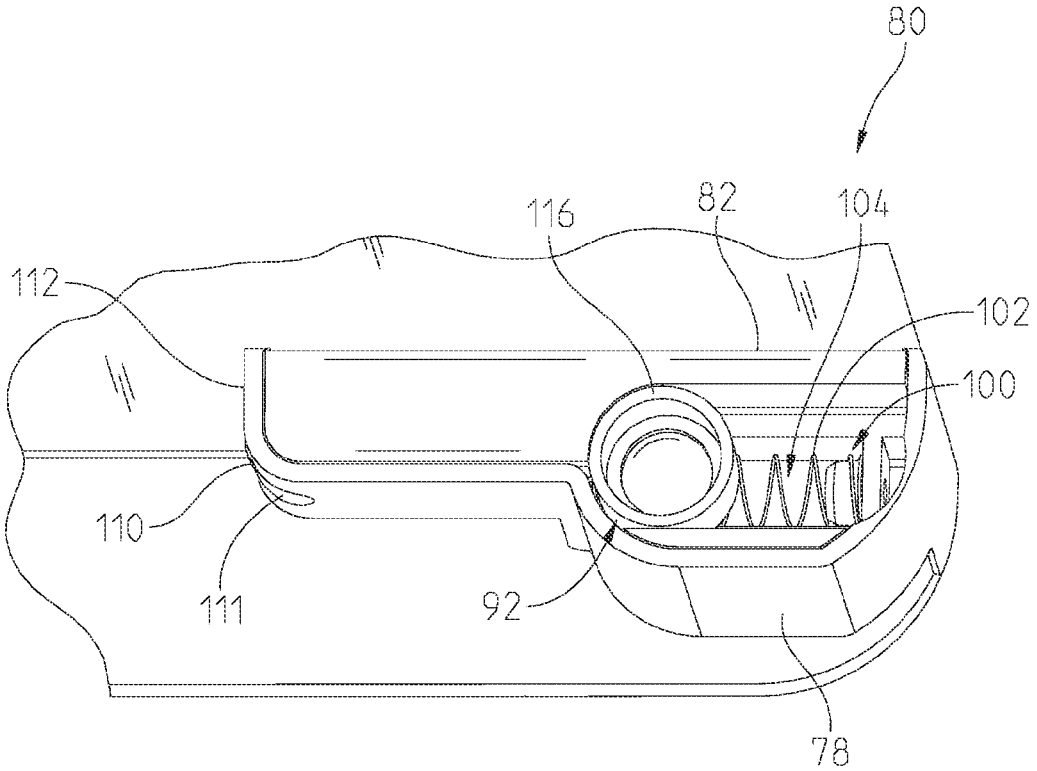
FIG. 7A is a partial perspective view of the seat cover, showing an illustrative slide assembly in a first position when the seat cover is in the lowered position of FIGS. 3A and 3B.
Figure 7B:
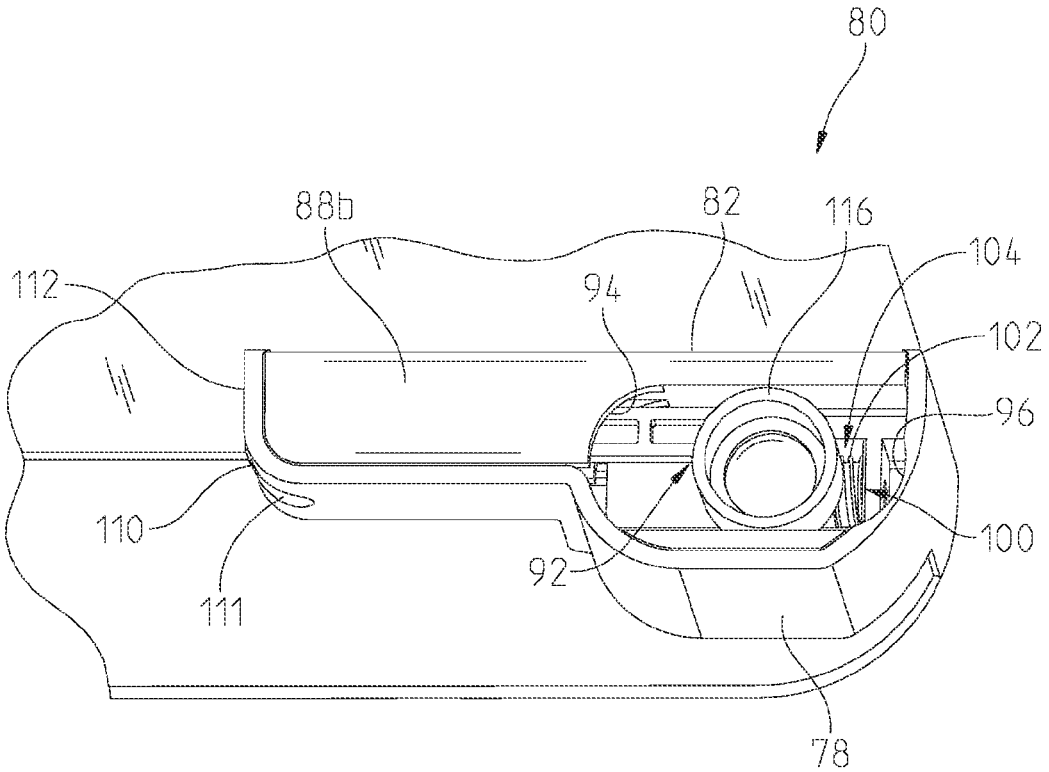
FIG. 7B is a partial perspective view similar to FIG. 7A, with the illustrative slide assembly in a second position when the seat is in the raised position of FIGS. 5A and 5B.

FIG. 7A illustrates the slide 92 in a first or home position corresponding to the longitudinal rearward position of the seat cover 34 when pivoted to the lowered position (FIG. 1A). FIG. 7B illustrates the slide 92 in a second position corresponding to a longitudinal forward position of the seat cover 34 when pivoted to the fully raised position (FIGS. 1B and 1C). A biasing device 100 is configured to bias the slide 92 toward the second position and hence the seat cover 34 to the longitudinal rearward position. Illustratively, the biasing device 100 comprises a spring 102 received within a spring pocket 104 defined by the insert 82 and extending parallel to the guide track 90.

Figure 8:
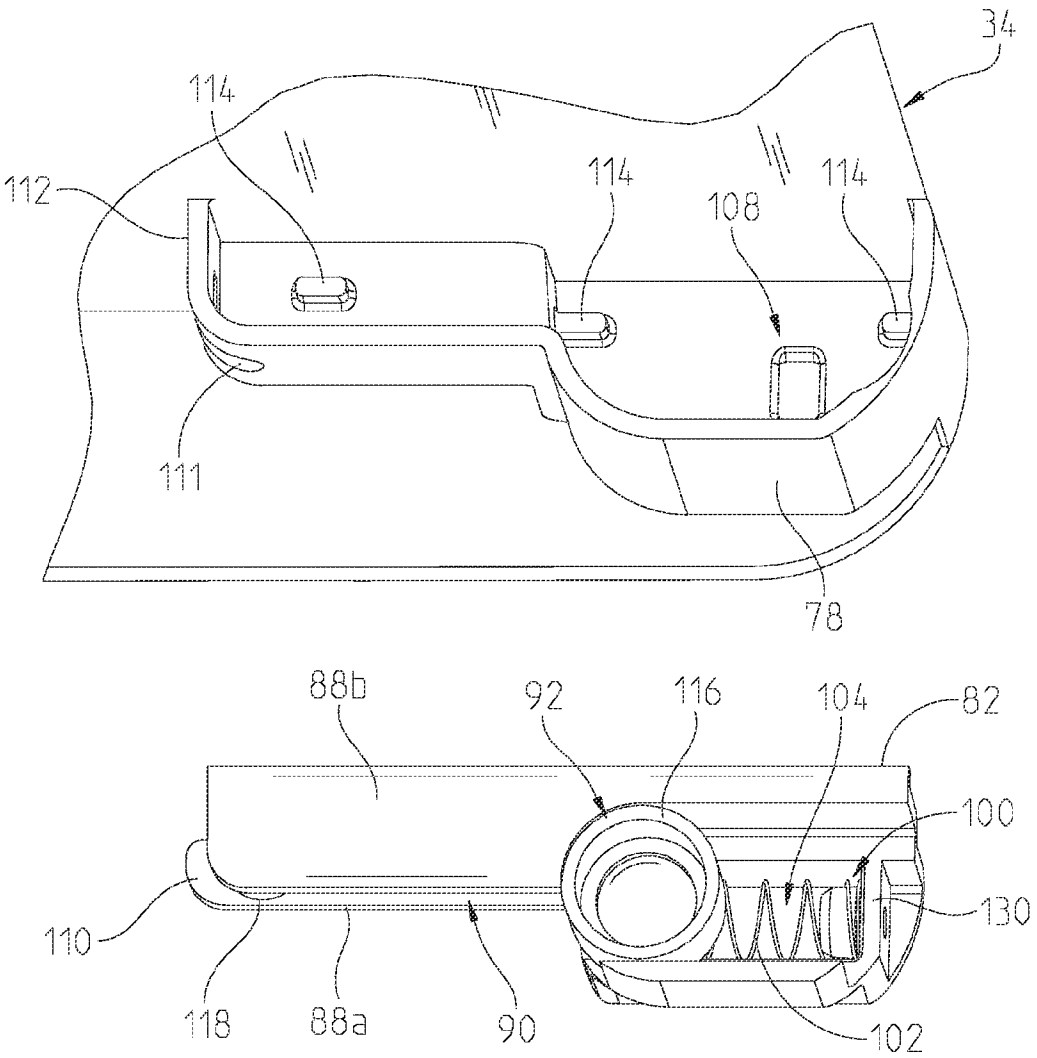
FIG. 8 is a partially exploded perspective view of the slide assembly of FIG. 7A.
Figure 9:
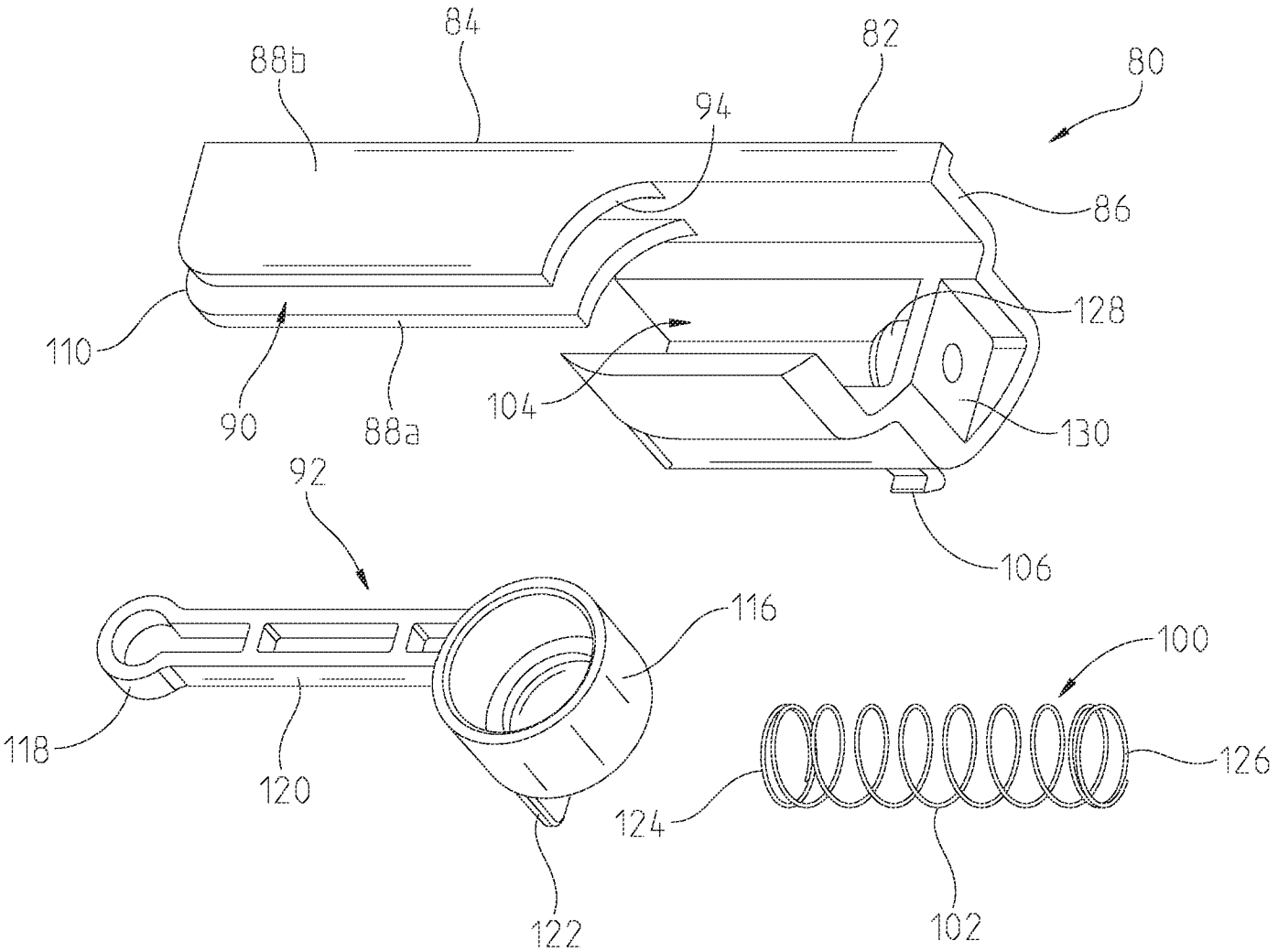
FIG. 9 is a front exploded perspective view of the slide assembly of FIG. 7A.
Figure 10:
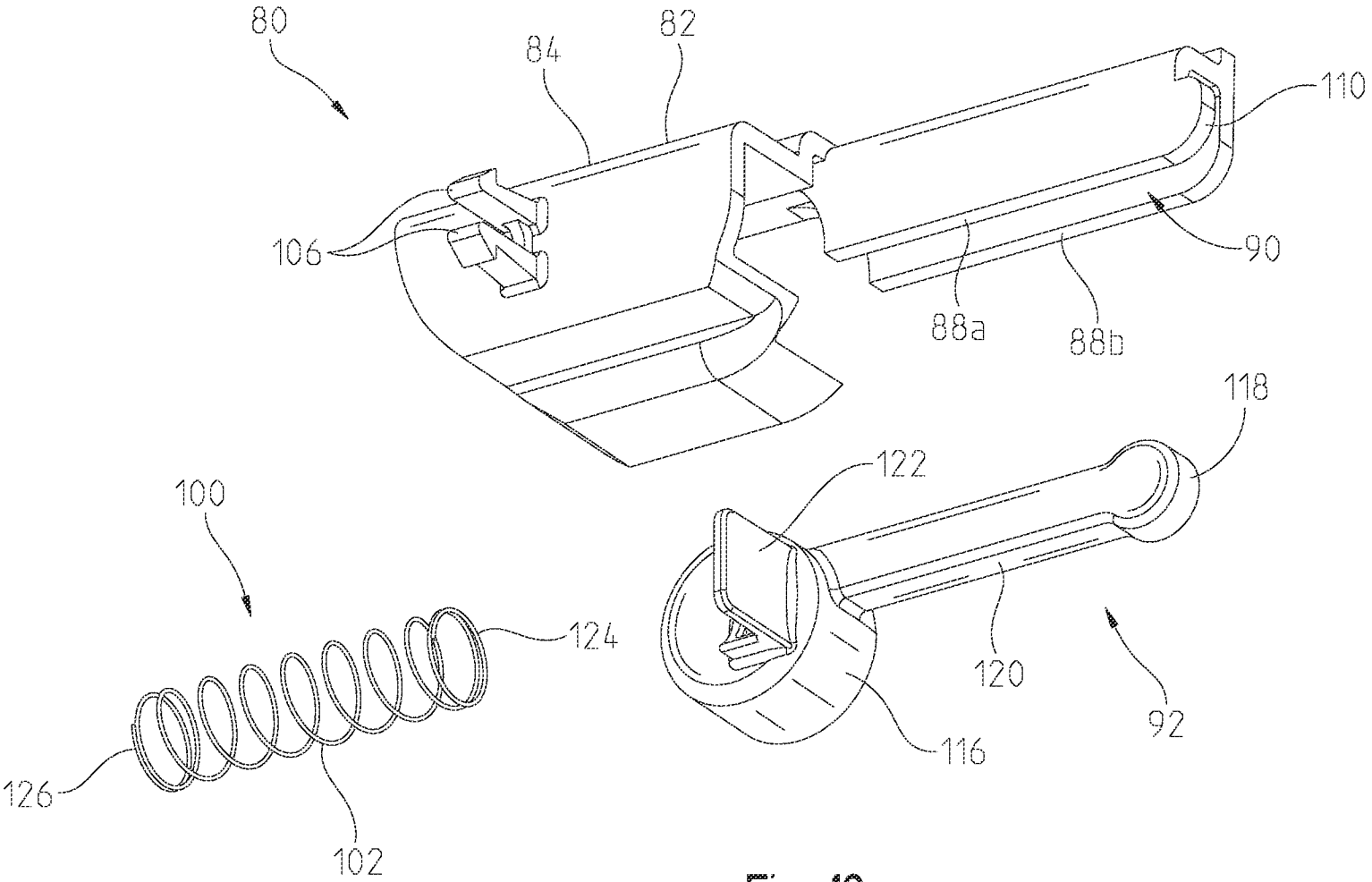
FIG. 10 is a rear exploded perspective view of the slide assembly of FIG. 7A.

With reference to FIGS. 8-10, the insert 82 is secured to the seat cover 34 by a pair of spring clips 106 received within an opening 108 within the seat pocket 78. A tab 110 extending from wall 88*a* is received within an opening 111 in end wall 112 of the seat pocket 78*a* to further locate and secure the insert 82 within the seat pocket 78. A plurality of standoffs 114 are configured to locate and space the insert 82 relative to the seat pocket 78.

The slide 92 includes a socket 116 at a first end, and a contact head 118 at a second end. A longitudinally extending arm 120 connects the socket 116 and the contact head 118. The socket 116 receives the outer portion 54 of the hinge 42. As such, the guide track 90 and the seat cover 34 are configured for translational movement relative to the hinge 42 and thereby the pivot axis 53 and the bowl 14. The contact head 118 is configured to guide the slide 92 in sliding movement within the guide track 90.

As noted above, the hinge receiving socket 116 is spaced from the contact head 118 at opposing ends of arm 120 of the slide 92. The length of the arm 120 opposes the moment force applied from the slow close mechanism of the hinge 42, thereby reducing the force required from the spring 102 to move or bias the slide 92 to the first position within the guide track 90 (FIG. 7A).

The slide 92 further includes a spring support 122 extending laterally from the socket 116 and engaging a first end 124 of the spring 102. A second end 126 of the spring 102 is received over a protrusion 128 extending from an end wall 130 of the spring pocket 104. As such, the spring 102 is compressed between the spring support 122 and the end wall 130.

With reference to FIGS. 3A-5B, a rear edge 132 of the seat cover 34 defines a driver, illustratively a rearwardly facing camming surface 134 that is configured to contact an engagement surface 136 of the toilet bowl 14. The camming surface 134 is arcuate, and illustratively defined by a radius R extending outwardly from a center point 138. In the illustrative embodiment, the radius R is approximately 1.25 inches. The curvature of the camming surface 134, along with the offset of the pivot axis 53 from the center point 138 of the radius R, provide for the camming action of the seat cover 34.

As the seat cover 34 is pivoted about pivot axis 53 from the lowered position to the raised position, the camming action of the camming surface 134 against the engagement surface 136 of the toilet bowl 14 causes the seat cover 34 to translate or move forwardly in a direction away from the toilet bowl 14. As the seat cover 34 moves forwardly, the slide 92 is moved within the guide track 90 against the bias of the spring 102 (FIGS. 5A and 7B). When lowering the seat cover 34, bias of the spring 102 causes the slide 92 to move back to its first or home position (FIGS. 3A and 7A). As such, the spring 102 biases the seat cover 34 to translate or move rearwardly in a direction toward the upper shelf 24 of the toilet bowl 14, thereby closing the gap 36 (FIG. 1A).

FIGS. 3A-5B illustrate various positions of the seat cover 34 relative to the toilet bowl 14. FIGS. 3A and 3B show the seat 32 and the seat cover 34 in lowered positions. The pivot axis 53 defined by the hinge 42 is illustratively located a distance D1 from the rear edge 132 of the seat cover 34. In the illustrative embodiment, distance D1 is approximately 1.697 inches.

Figure 4A:
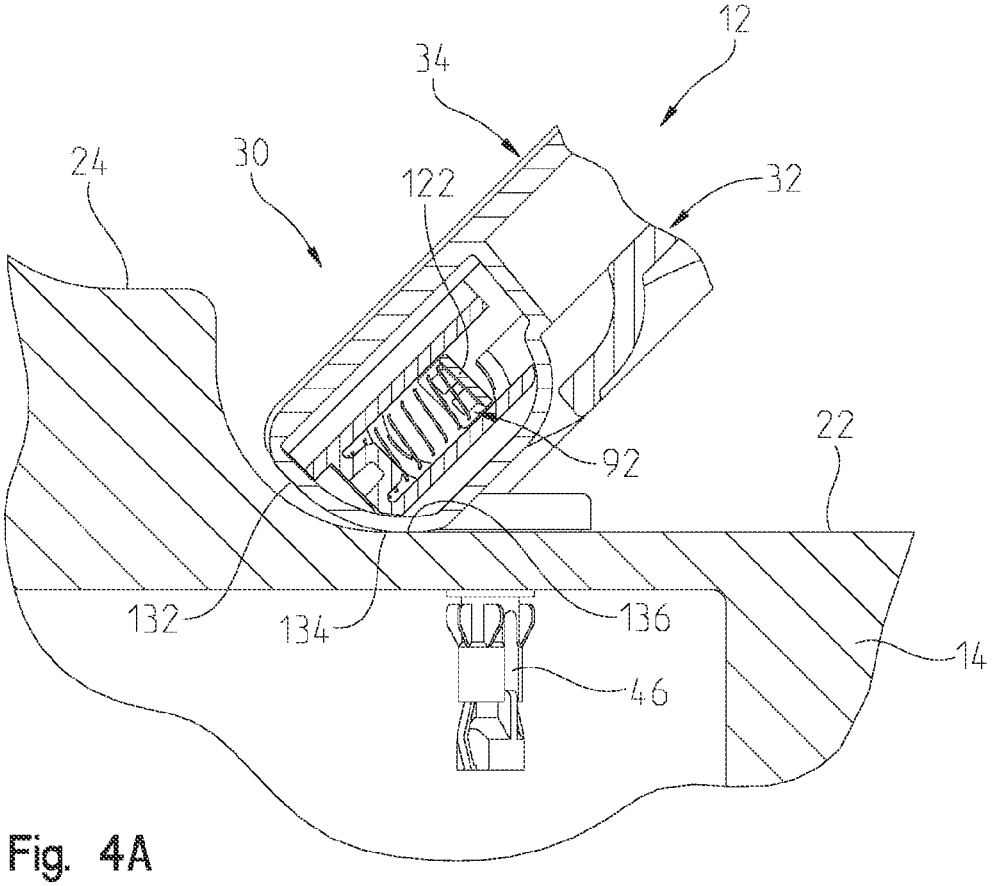
FIG. 4A is a cross-sectional view of the seat assembly similar to FIG. 3A, showing the seat and the seat assembly in intermediate, partially raised positions.
Figure 4B:
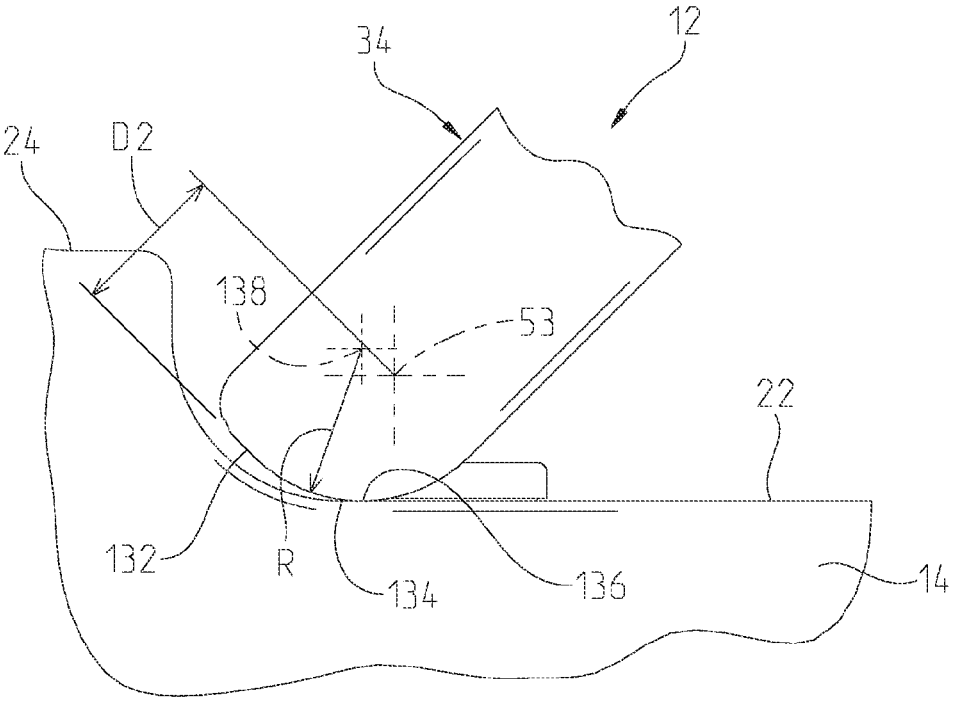
FIG. 4B is a side elevational view of the seat assembly of FIG. 4A.

FIGS. 4A and 4B show the seat 32 and the seat cover 34 in intermediate positions (rotated upwardly by approximately 45 degrees). The pivot axis 53 defined by the hinge 42 is located a distance D2 from the rear edge 132 of the seat cover 34. In the illustrative embodiment, distance D2 is approximately 1.285 inches.

FIGS. 5A and 5B show the seat 32 and the seat cover 34 in fully raised positions (rotated upwardly by approximately 90 degrees). The pivot axis 53 defined by the hinge 42 is located a distance D3 from the rear edge 132 of the seat cover 34. In the illustrative embodiment, distance D3 is approximately 1.029 inches. In the illustrative embodiment, the rear edge 132 of the seat cover 34 moves relative to the pivot axis 53 from distance D1 (illustratively 1.697 inches) to distance D3 (illustratively 1.029 inches), a distance of approximately 0.668 inches, as the seat cover 34 is pivoted from the lowered position of FIGS. 3A and 3B to the fully raised position of FIGS. 5A and 5B.

In operation, bias from the spring 102 causes the seat cover 34 to be in the longitudinal rearward position when pivoted to the lowered position (FIGS. 3A and 3B), thereby reducing the gap 36 for an aesthetically pleasing appearance. As the seat cover 34 is pivoted upwardly to the fully raised position, the camming surface 134 engages the engagement surface 136 of the toilet bowl 14 thereby forcing the seat cover 34 in translational movement to the forward position (FIGS. 5A and 5B), thereby increasing the gap 38 to provide clearance for pivoting movement of the seat cover 34.

With reference to FIGS. 12-16, a further embodiment toilet seat assembly 212 may be coupled to the toilet bowl 14 by the illustrative mounting system 230 of the present disclosure. The toilet seat assembly 212 and mounting system 230 include many similar components as the toilet seat assembly 12 and mounting system 30 detailed above. As such, in the following description similar components will be identified with like reference numbers.

The illustrative seat cover 234 may be formed of a polymer and illustratively includes a top wall 270, laterally spaced side walls 272, and a front wall 274. The top wall 270 illustratively includes an upper surface 237 and a lower surface 275. A plurality of standoffs 276 are illustratively supported by the lower surface 275 of the top wall 270 and are configured to rest upon the toilet seat 32 when the seat cover 234 is in a lowered position. Laterally spaced pockets 278*a* and 278*b* are illustratively molded into the lower surface 275 of the seat cover 234 and are configured to receive laterally spaced slide assemblies 280*a* and 280*b*.

The slide assemblies 280*a* and 280*b* are generally mirror images of each other. As such, the following description will focus on slide assembly 280*a* with the understanding that slide assembly 280*b* is substantially identical.

Each slide assembly 280 illustratively includes a guide, illustratively a guide rod 290 extending between opposing end walls 282 and 284 of the pocket 278. In one illustrative embodiment, the opposing ends of the guide rod 290 may be press fit within end walls 282 and 284. A slide 292 is received for longitudinally sliding movement within the pocket 278 along the guide rod 290. The end walls 282 and 284 may define end of travel limits of the slide 292.

Figure 13A:
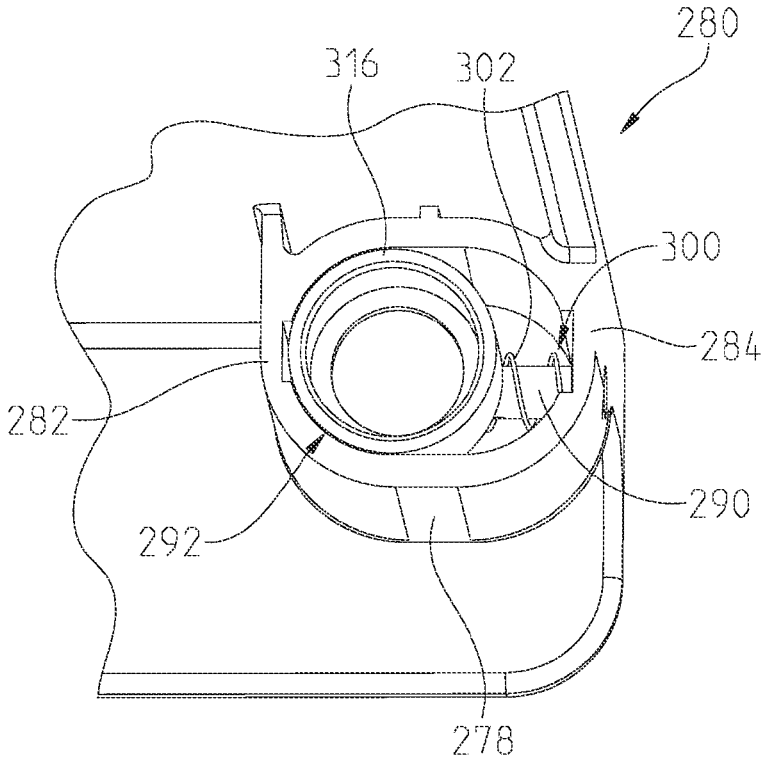
FIG. 13A is a partial perspective view of the seat cover of FIG. 12, showing a further illustrative slide assembly in a first position when the seat is in a lowered position.
Figure 13B:
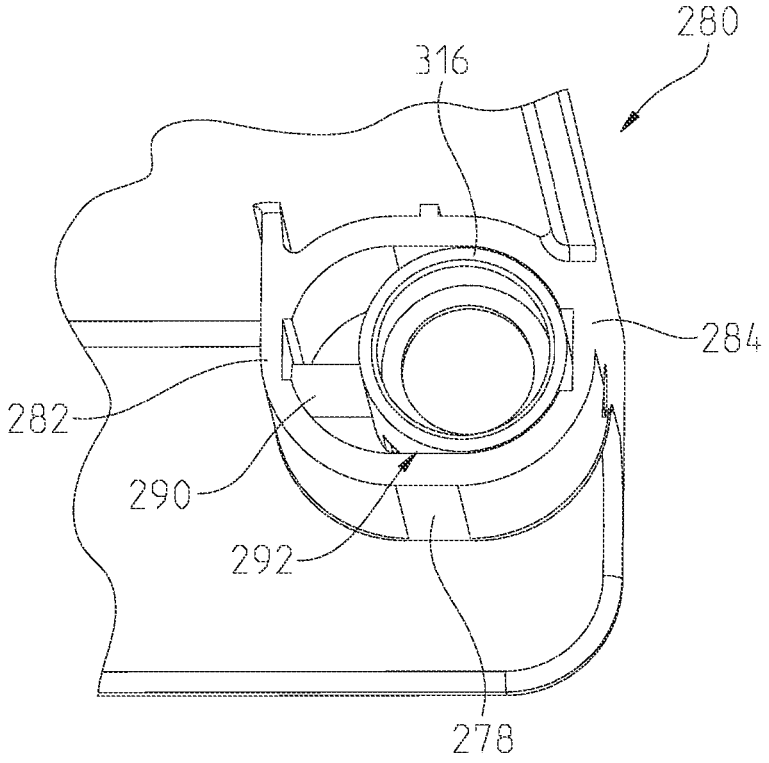
FIG. 13B is a partial perspective view similar to FIG. 13A, with the illustrative slide assembly in a second position when the seat is in a raised position.
Figure 14:
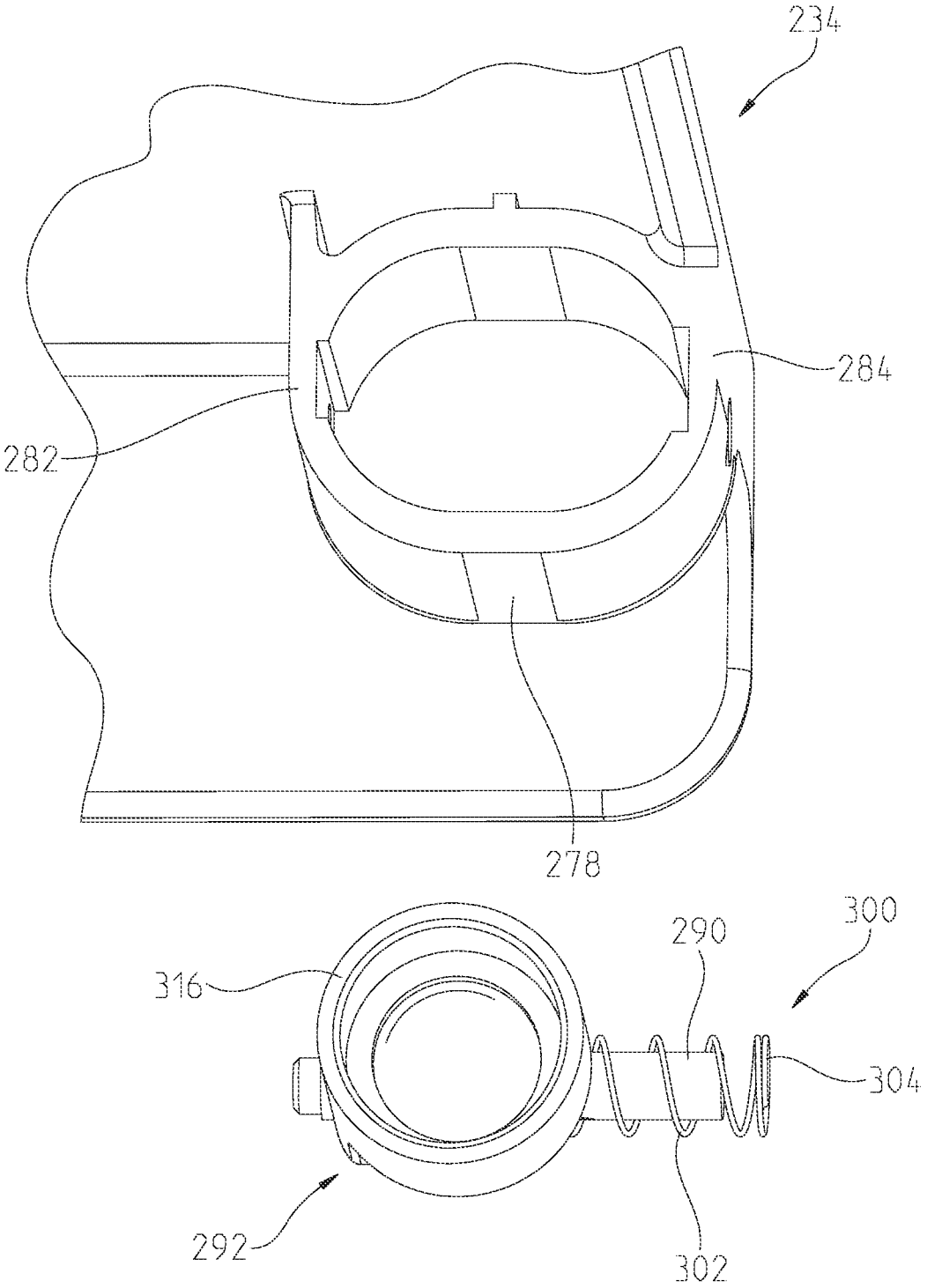
FIG. 14 is a partially exploded perspective view of the slide assembly of FIG. 13A.
Figure 15:
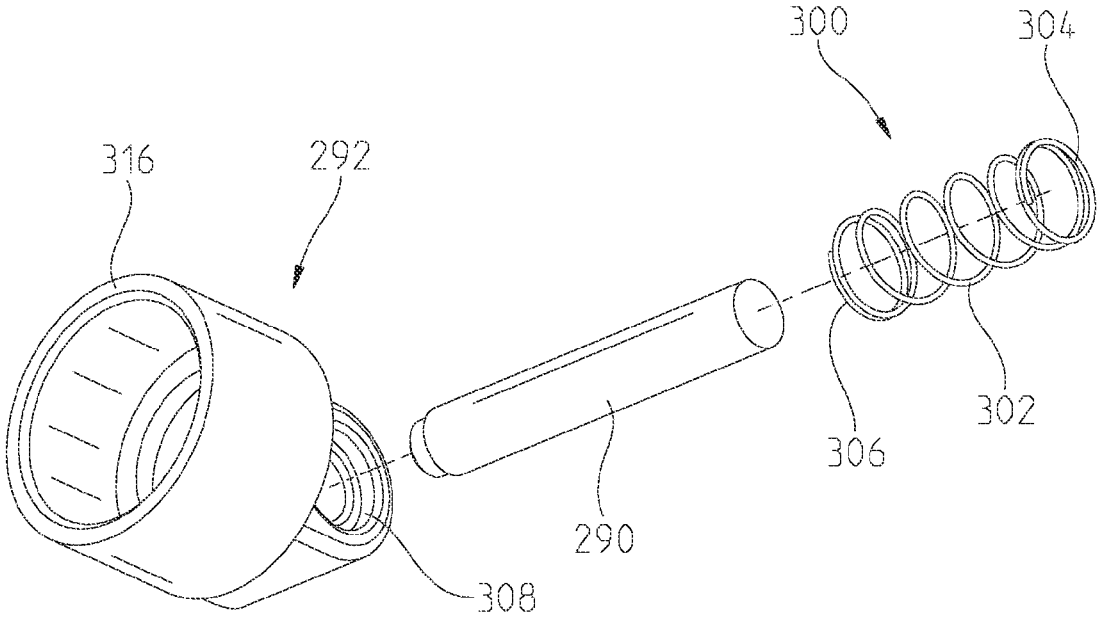
FIG. 15 is a front exploded perspective view of the slide assembly of FIG. 13A.
Figure 16:
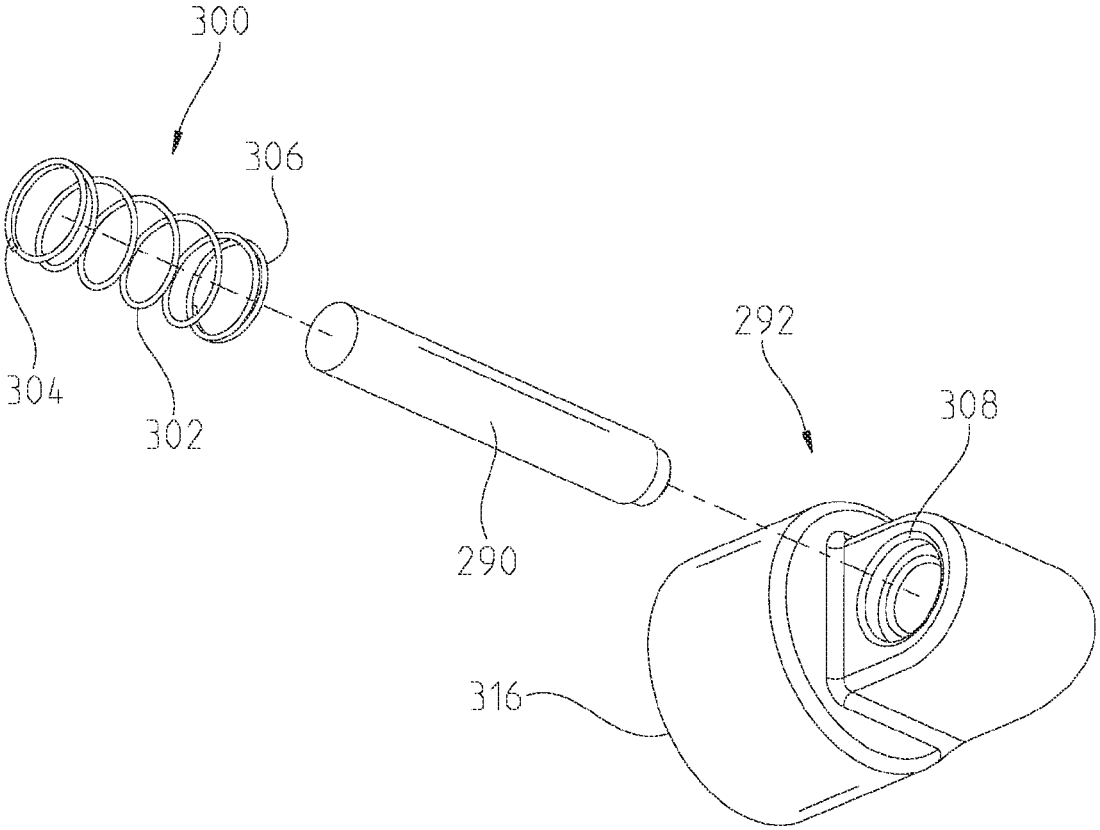
FIG. 16 is a rear exploded perspective view of the slide assembly of FIG. 13A.

FIG. 13A illustrates the slide 292 in a first or home position corresponding to a longitudinal rearward position of the seat cover 234 when pivoted to a lowered position (similar to that detailed above in connection with the seat cover 34 in FIG. 1A). FIG. 13B illustrates the slide 292 in a second position corresponding to a longitudinal forward position of the seat cover 234 when pivoted to a fully raised position (similar to that detailed above in connection with the seat cover 34 in FIGS. 1B and 1C). A biasing device 300 is configured to bias the slide 292 toward the second position and hence the seat cover 234 to the longitudinal rearward position. With reference to FIGS. 14-16, the biasing device 300 illustratively comprises a spring 302 received on the guide rod 290. A first end 304 of the spring 302 engages the end wall 284, and a second end 306 of the spring 302 is received within a pocket 308 formed within the slide 292.

The slide 292 includes a socket 316 which receives the outer portion 54 of the hinge 42. As such, the pocket 278 of the seat cover 234 and the guide rod 290 are configured for translational movement relative to the hinge 42 and thereby the pivot axis 53 and the bowl 14. The guide rod 290 is configured to guide the slide 292 in sliding movement within the pocket 278.

Although the invention has been described in detailed with reference to certain preferred embodiments, variations of modifications exist within the spirit and scope of the invention as described and defined in the following claims.

The invention claimed is:

1. A toilet seat cover mounting system comprising:
a seat;
a seat cover supported above the seat;
a hinge operably coupled to the seat cover and supporting the seat cover for pivoting movement between a lowered position and a raised position;
a slide assembly operably coupled to the seat cover, the slide assembly including a slide having a socket receiving the hinge, and a guide supporting the socket for sliding movement as the seat cover moves longitudinally between a rearward position and a forward position; and
a camming surface supported by the seat cover and configured to engage with a toilet bowl to move the seat cover relative to socket from the rearward position to the forward position as the seat cover is pivoted from the lowered position to the raised position.

2. The toilet seat cover mounting system of claim 1, wherein the slide assembly further includes a biasing device operably coupled to the slide and the seat cover for biasing the seat cover toward the rearward position.

3. The toilet seat cover mounting system of claim 2, wherein the biasing device is a spring.

4. The toilet seat cover mounting system of claim 3, wherein the slide assembly further includes a spring pocket extending parallel to the guide and configured to receive the spring.

5. The toilet seat cover mounting system of claim 4, wherein the slide of the slide assembly further includes a spring support configured to engage the spring.

6. The toilet seat cover mounting system of claim 1, wherein the slide of the slide assembly further includes a contact head, and a longitudinally extending arm positioned between the socket and the contact head.

7. The toilet seat cover mounting system of claim 1, wherein the guide of the slide assembly is defined by an insert received within a pocket supported by a lower surface of the seat cover.

8. The toilet seat cover mounting system of claim 1, wherein the hinge is a slow close hinge including a dampener to control movement of the seat cover from the raised position to the lowered position.

9. A toilet seat cover mounting system comprising:
an engagement surface supported by a toilet bowl;
a seat cover supported for pivoting movement relative to the toilet bowl between a lowered position and a raised position, and supported for translational movement relative to the toilet bowl between a rearward position and a forward position; and
a camming surface supported by the seat cover and configured to cooperate with the engagement surface to translationally move the seat cover from the rearward position to the forward position as the seat cover is pivoted from the lowered position to the raised position.

10. The toilet seat cover mounting system of claim 9, further comprising a hinge operably coupled to the seat cover for pivoting the seat cover between the lowered position and the raised position.

11. The toilet seat cover mounting system of claim 10, further comprising a seat operably coupled to the hinge for pivoting the seat between a lowered position and a raised position.

12. The toilet seat cover mounting system of claim 10, further comprising a slide assembly operably coupled to the seat cover, the slide assembly including a slide having a socket to receive the hinge, and a guide to support the socket for sliding movement as the seat cover moves between the rearward position and the forward position.

13. The toilet seat cover mounting system of claim 12, wherein the slide assembly further includes a biasing device operably coupled to the slide and the seat cover for biasing the seat cover toward the rearward position.

14. The toilet seat cover mounting system of claim 13, wherein the biasing device is a spring.

15. The toilet seat cover mounting system of claim 14, wherein the slide assembly further includes a spring pocket extending parallel to the guide and configured to receive the spring.

16. The toilet seat cover mounting system of claim 15, wherein the slide of the slide assembly further includes a spring support configured to engage the spring.

17. The toilet seat cover mounting system of claim 12, wherein the slide of the slide assembly further includes a contact head, and a longitudinally extending arm positioned between the socket and the contact head.

18. The toilet seat cover mounting system of claim 12, wherein the guide of the slide assembly is defined by an insert received within a pocket supported by a lower surface of the seat cover.

19. The toilet seat cover mounting system of claim 10, wherein the hinge is a slow close hinge including a dampener to control movement of the seat cover from the raised position to the lowered position.

20. A toilet seat cover mounting system comprising:
a seat cover;
a hinge operably coupled to the seat cover and configured to support the seat cover for pivoting movement between a lowered position and a raised position;
a slide assembly operably coupled to the seat cover and configured to support the seat cover for translational movement between a rearward position and a forward position; and
a driver supported by the seat cover and configured to translationally move the seat cover from the rearward position to the forward position in response to the seat cover being pivoted from the lowered position to the raised position.

21. The toilet seat cover mounting system of claim 20, wherein the slide assembly includes a slide having a socket to receive the hinge, and a guide supporting the socket for sliding movement as the seat cover moves from the rearward position and the forward position.

22. The toilet seat cover mounting system of claim 21, wherein the slide of the slide assembly further includes a contact head, and a longitudinally extending arm positioned between the socket and the contact head.

23. The toilet seat cover mounting system of claim 20, wherein the hinge is a slow close hinge including a dampener to control movement of the seat cover from the raised position to the lowered position.

24. The toilet seat cover mounting system of claim 20, wherein the driver comprises a camming surface configured to engage with a toilet bowl.

25. A toilet seat cover mounting system comprising:

a seat cover;

a hinge operably coupled to the seat cover and configured to support the seat cover for pivoting movement between a lowered position and a raised position; and a slide assembly operably coupled to the seat cover and configured to support the seat cover for translational movement between a rearward position and a forward position;

wherein the slide assembly includes a slide having a socket to receive the hinge, and a guide supporting the socket for sliding movement as the seat cover moves from the rearward position and the forward position; and wherein the slide assembly further includes a biasing device operably coupled to the slide and the seat cover for biasing the seat cover toward the rearward position.

26. The toilet seat cover mounting system of claim 25, wherein the biasing device is a spring.

27. The toilet seat cover mounting system of claim 26, wherein the slide assembly further includes a spring pocket extending parallel to the guide and configured to receive the spring.

28. The toilet seat cover mounting system of claim 26, wherein the slide of the slide assembly further includes a spring support configured to engage the spring.

29. A toilet seat cover mounting system comprising:

a seat cover;

a hinge operably coupled to the seat cover and configured to support the seat cover for pivoting movement between a lowered position and a raised position;

a slide assembly operably coupled to the seat cover and configured to support the seat cover for translational movement between a rearward position and a forward position;

wherein the slide assembly includes a slide having a socket to receive the hinge, and a guide supporting the socket for sliding movement as the seat cover moves from the rearward position and the forward position; and wherein the guide of the slide assembly is defined by an insert received within a pocket supported by a lower surface of the seat cover.

30. A toilet seat cover mounting system including a toilet seat cover configured to translate between a rearward position and a forward position in response to the toilet seat cover being pivoted between a lowered position and a raised position.

31. The toilet seat cover mounting system of claim 30, further comprising a driver supported by the toilet seat cover and configured to translationally move the toilet seat cover from the rearward position to the forward position in response to the toilet seat cover being pivoted from the lowered position to the raised position.

32. The toilet seat cover mounting system of claim 31, wherein the driver comprises a camming surface configured to engage with a toilet bowl.

* * * * *